US008217290B2

(12) United States Patent
Rakus et al.

(10) Patent No.: US 8,217,290 B2
(45) Date of Patent: Jul. 10, 2012

(54) ELECTRICAL SWITCHING APPARATUS, AND CHARGING ASSEMBLY AND CHARGING HANDLE THEREFOR

(75) Inventors: Paul R. Rakus, Beaver Falls, PA (US); Valerie F. Odom, McKees Rocks, PA (US); Andrew L. Gottschalk, Pittsburgh, PA (US); Craig A. Rodgers, Butler, PA (US); Nathan J. Weister, Darlington, PA (US); Erik R. Bogdon, Carnegie, PA (US)

(73) Assignee: Eaton Corporation, Cleveland, OH (US)

( * ) Notice: Subject to any disclaimer, the term of this patent is extended or adjusted under 35 U.S.C. 154(b) by 800 days.

(21) Appl. No.: 12/026,629

(22) Filed: Feb. 6, 2008

(65) Prior Publication Data

US 2008/0197003 A1 Aug. 21, 2008

Related U.S. Application Data

(60) Provisional application No. 60/890,209, filed on Feb. 16, 2007.

(51) Int. Cl.
*H01H 5/00* (2006.01)

(52) U.S. Cl. ..... 200/400; 200/401; 200/332

(58) Field of Classification Search ..... 200/400, 200/401, 500, 501; 218/153, 154
See application file for complete search history.

(56) References Cited

U.S. PATENT DOCUMENTS

| | | | | |
|---|---|---|---|---|
| 5,274,206 | A | 12/1993 | Milianowicz | |
| 5,938,008 | A | 8/1999 | Wehrli, III et al. | |
| 6,054,655 | A * | 4/2000 | Rudolph et al. | 200/16 R |
| 6,064,021 | A | 5/2000 | Wehrli et al. | |
| 6,160,234 | A * | 12/2000 | Wehrli et al. | 200/400 |

* cited by examiner

*Primary Examiner* — Renee Luebke
*Assistant Examiner* — Marina Fishman
(74) *Attorney, Agent, or Firm* — Dawn C. Wolff; Martin J. Moran

(57) ABSTRACT

A charging handle is provided for an electrical switching apparatus including a housing having an exterior, an interior and a recess extending from the exterior toward the interior, separable contacts enclosed by the housing, an operating mechanism for opening and closing the separable contacts, and a charging assembly. A first end of the charging handle is coupled to the charging assembly within the interior of the housing. The second end includes a finger pull. An elongated body extends between the first and second ends and includes first and second sides, and inner and outer surfaces. The charging handle is movable among first and second positions. The finger pull is disposed on the outer surface of the elongated body at or about the second end of the charging handle, and is readily accessible from all of the second end and the first and second sides of the charging handle.

19 Claims, 5 Drawing Sheets

2

ELECTRICAL SWITCHING APPARATUS, AND CHARGING ASSEMBLY AND CHARGING HANDLE THEREFOR

CROSS-REFERENCE TO RELATED APPLICATION

This application claims the benefit of U.S. Provisional Patent Application Ser. No. 60/890,209, filed Feb. 16, 2007.

BACKGROUND OF THE INVENTION

1. Field of the Invention

The invention relates generally to electrical switching apparatus and, more particularly, to charging assemblies for electrical switching apparatus, such as circuit breakers. The invention also relates to charging handles for circuit breaker charging mechanisms.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

Many low-voltage circuit breakers, for example, employ a molded housing having a cover. The operating mechanism for such circuit breakers is structured to open and close separable electrical contacts, which are enclosed by the molded housing. More specifically, the operating mechanism includes a charging assembly having a close spring and a charging handle. The close spring stores energy for closing the circuit breaker, and is charged by pulling the charging handle a number of times. When the charging handle is not being employed, it is typically stowed in an upright position within a recess in the cover of the circuit breaker housing, and is held there by a handle return spring. Low-voltage circuit breakers and charging assemblies therefor are described, in detail, for example, in U.S. Pat. Nos. 5,938,008, 6,064,021, and 6,160,234, which are incorporated herein by reference.

It can be difficult for an operator to gain the necessary access to the charging handle (e.g., insert a finger underneath the handle) to remove (e.g., pivot it far enough with respect to the housing cover) it from the recess and have access to a sufficient portion of the charging handle to grasp it and begin the charging operation. Additionally, known charging handles for charging circuit breaker operating mechanisms tend to be relatively narrow, and often have relatively abrupt (e.g., sharp) edges. This can cause discomfort to the operator when the operator pulls on the handle and experiences the load associated with charging the breaker. These disadvantages are particularly pronounced in view of the market trend toward smaller circuit breakers. Specifically, the relatively small size of circuit breakers inhibits the ability to quickly, easily and relatively comfortably operate the user interface features of the circuit breaker, including the charging handle. Added to this is the fact that the individuals (e.g., without limitation, electricians) who typically operate the circuit breakers sometimes prefer or insist on wearing work gloves, which can make manipulation of the charging handle very difficult.

In an attempt to overcome this disadvantage, one prior proposal has been to include a molded finger recess in the cover of the circuit breaker housing. Specifically, a recess is provided as a molded feature extending from the outer surface of the housing cover and protruding into the interior of the housing. The recess is intended to be deep enough for the operator to reach his or her finger underneath the end of the charging handle. However, this undesirably results in the recess protruding a significant distance into the interior of the circuit breaker housing and taking up valuable space therein. Another disadvantage is that such recesses tend to favor either right-handed or left-handed operators by providing access to only one of the left and right sides of the charging handle. See, e.g., U.S. Pat. Nos. 5,938,008, 6,064,021, and 6,160,234 (each showing a recess for a charging handle which provides access only to the right side of the charging handle).

There is, therefore, room for improvement in electrical switching apparatus, such as circuit breakers, and in charging assemblies and charging handles therefor.

SUMMARY OF THE INVENTION

These needs and others are met by embodiments of the invention, which are directed to an optimized charging handle for a charging assembly of an electrical switching apparatus. Among other benefits, the charging handle has a maximum length and associated mechanical leverage, offers improved accessibility by an operator, and has an ergonomic and user-friendly design.

As one aspect of the invention, a charging handle is provided for an electrical switching apparatus. The electrical switching apparatus includes a housing having an exterior, an interior and a recess extending from the exterior toward the interior, separable contacts enclosed by the housing, an operating mechanism structured to open and close the separable contacts, and a charging assembly. The charging handle comprises: a first end structured to be coupled to the charging assembly within the interior of the housing; a second end disposed opposite and distal from the first end and including a finger pull; and an elongated body extending between the first end and the second end, the elongated body including a first side, a second side, an inner surface structured to extend toward the interior of the housing, and an outer surface disposed opposite the inner surface. The charging handle is movable among a first position in which the elongated body is structured to be disposed generally within the recess of the housing, and a second position in which the second end of the charging handle is structured to extend outwardly from the recess of the housing. The finger pull is disposed on the outer surface of the elongated body at or about the second end of the charging handle, in order that the finger pull is readily accessible from all of: the second end of the charging handle, the first side of the elongated body of the charging handle, and the second side of the elongated body of the charging handle.

The finger pull may comprise a protrusion extending outwardly from the outer surface of the elongated body of the charging handle at or about the second end of the charging handle. The finger pull may further comprise a pocket extending inwardly from the outer surface of the elongated body of the charging handle toward the inner surface of the elongated body of the charging handle at or about the second end of the charging handle. The elongated body of the charging handle may have a first axis, and the protrusion may have a second axis, wherein the first axis of the charging handle and the second axis of the protrusion intersect at an angle. The angle may be less than 90 degrees, in order that the protrusion of the finger pull overlays at least a portion of the pocket of the finger pull.

As another aspect of the invention, a charging assembly is provided for an electrical switching apparatus. The electrical switching apparatus includes a housing having an exterior, an interior and a recess extending from the exterior toward the interior, separable contacts enclosed by the housing, and an operating mechanism structured to open and close the separable contacts. The charging assembly comprises: a spring coupled to the operating mechanism, the spring being structured to be chargeable in order to cause the operating mechanism to close the separable contacts; and a charging handle structured to charge the spring, the charging handle comprising: a first end structured to be coupled to the charging assembly within the interior of the housing, a second end disposed opposite and distal from the first end and including a finger pull, and an elongated body extending between the first end and the second end, the elongated body including a first side, a second side, an inner surface structured to extend toward the interior of the housing, and an outer surface disposed opposite the inner surface. The charging handle is movable among a first position in which the elongated body is structured to be generally disposed within the recess of the housing, and a second position in which the second end of the charging handle is structured to extend outwardly from the recess of the housing. When the charging handle is moved from the first position toward the second position, the spring of the charging assembly of the operating mechanism is charged. The finger pull is disposed on the outer surface of the elongated body at or about the second end of the charging handle, in order that the finger pull is readily accessible from all of: the second end of the charging handle, the first side of the elongated body of the charging handle, and the second side of the elongated body of the charging handle.

As another aspect of the invention, an electrical switching apparatus comprises: a housing including an exterior, an interior, and a cover comprising a recess, the recess of the cover extending from the exterior of the housing toward the interior of the housing; separable contacts enclosed by the housing; an operating mechanism structured to open and closed the separable contacts; and a charging assembly comprising: a spring coupled to the operating mechanism, the spring being chargeable in order to cause the operating mechanism to close the separable contacts, and a charging handle comprising: a first end coupled to the charging assembly within the interior of the housing, a second end disposed opposite and distal from the first end and including a finger pull, and an elongated body extending between the first end and the second end, the elongated body including a first side, a second side, an inner surface extending toward the interior of the housing, and an outer surface disposed opposite the inner surface. The charging handle is movable among a first position in which the elongated body is generally disposed within the recess of the cover of the housing, and a second position in which the second end of the charging handle extends outwardly from the recess of the cover of the housing. When the charging handle is moved from the first position toward the second position, the spring of the charging assembly of the operating mechanism is structured to be charged. The finger pull is disposed on the outer surface of the elongated body at or about the second end of the charging handle, in order that the finger pull is readily accessible from all of: the second end of the charging handle, the first side of the elongated body of the charging handle, and the second side of the elongated body of the charging handle.

The cover of the housing may have a first depth, and the recess of the cover may have a second depth, wherein the second depth of the recess is substantially less than the first depth of the cover of the housing, in order to minimize the amount of space occupied by the recess within the interior of the housing. The cover of the housing may further comprises a finger well, wherein the finger well extends from the exterior of the housing toward the interior of the housing and has a third depth. The third depth of the finger well may be substantially less than the second depth of the recess.

The recess may have a first end and a second end disposed opposite and distal from the first end. The first end of the charging handle may be disposed within the first end of the recess. When the charging handle is disposed in the first position, the second end of the charging handle may be substantially disposed within the second end of the recess. The finger well may be a concave arcuate indentation in the cover of the housing, wherein the concave arcuate indentation is disposed at or about the second end of the recess. The second end of the charging handle may extend beyond the concave arcuate indentation.

As another aspect of the invention, an electrical switching apparatus comprises: a housing including an exterior, an interior, and a cover comprising a recess, the recess of the cover extending from the exterior of the housing toward the interior of the housing; separable contacts enclosed by the housing; an operating mechanism structured to open and close the separable contacts; and a charging assembly comprising: a spring coupled to the operating mechanism, the spring being chargeable in order to cause the operating mechanism to close the separable contacts, and a charging handle comprising: a first end coupled to the charging assembly within the interior of the housing, a second end disposed opposite and distal from the first end and including a finger pull, and an elongated body extending between the first end and the second end, the elongated body including a first side, a second side, an inner surface extending toward the interior of the housing, and an outer surface disposed opposite the inner surface. The charging handle is movable among a first position in which the elongated body is generally disposed within the recess of the cover of the housing, and a second position in which the second end of the charging handle extends outwardly from the recess of the cover of the housing. When the charging handle is moved from the first position toward the second position, the spring of the charging assembly of the operating mechanism is charged. The finger pull is disposed on the outer surface of the elongated body at or about the second end of the charging handle. The cover of the housing provides access to the finger pull from the second end of the charging handle, to both the first side of the elongated body of the charging handle and the second side of the elongated body of the charging handle.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
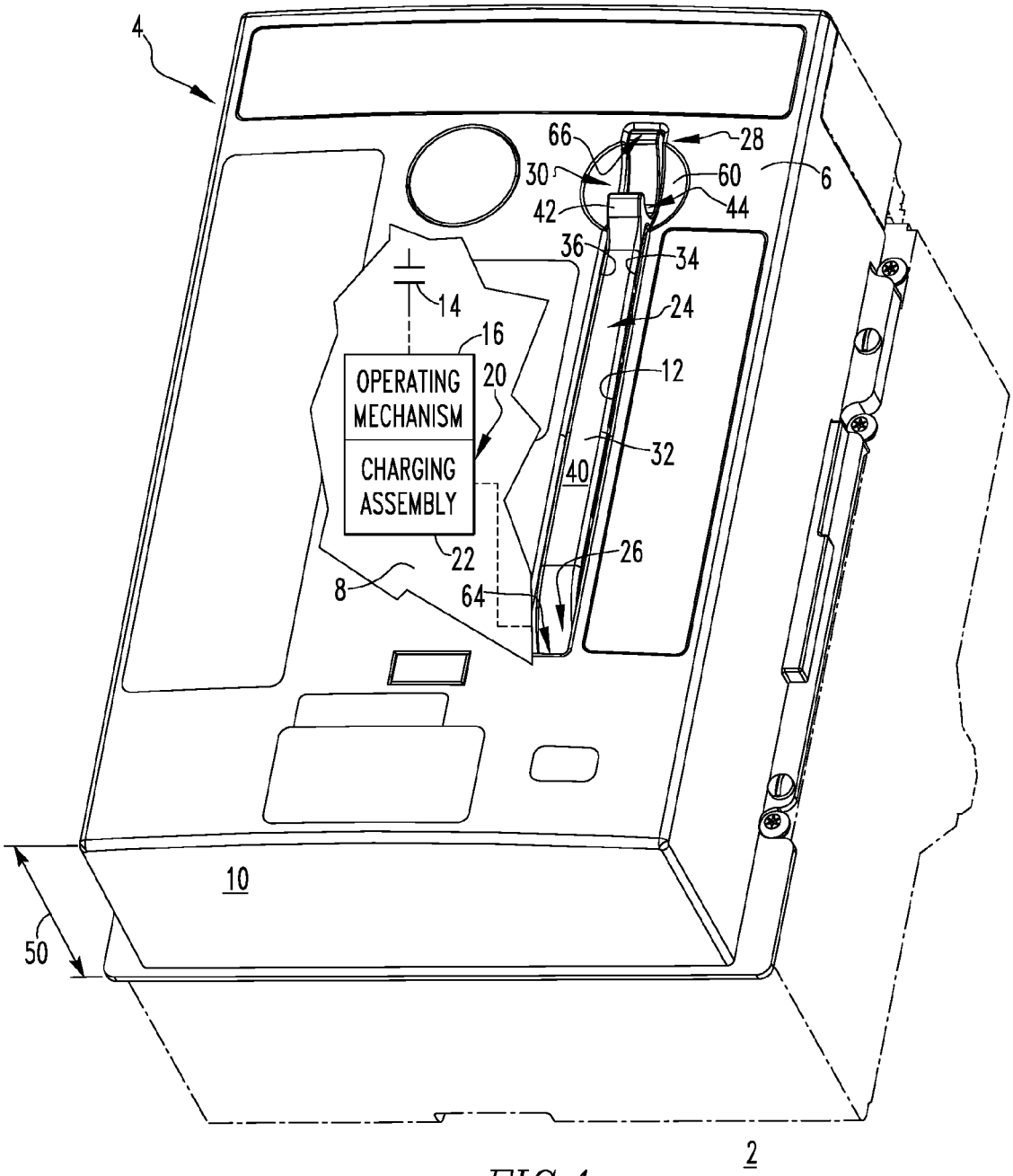
FIG. 1 is an isometric view of a low-voltage circuit breaker, and charging assembly and charging handle therefor, in accordance with an embodiment of the invention, with the charging handle shown in the stowed position and a portion of the circuit breaker housing cover cut away to show internal structures in simplified form.

For purposes of illustration, embodiments of the invention will be described as applied to a charging handle for the charging assembly of an operating mechanism for a low-voltage circuit breaker, although it will become apparent that they could also be applied to any known or suitable electrical switching apparatus (e.g., without limitation, circuit switching devices and circuit interrupters such as circuit breakers other than low-voltage circuit breakers, network protectors, contactors, motor starters, motor controllers and other load controllers).

Directional phrases used herein, such as, for example, left, right, top, bottom, upper, lower, front, back, clockwise, counterclockwise and derivatives thereof, relate to the orientation of the elements shown in the drawings and are not limiting to the claims unless expressly recited therein.

As employed herein, the terms "fastener" and "fastening mechanism" refer to any suitable connecting or tightening material or device expressly including, but not limited to, rivets (e.g., without limitation, pop rivets), screws, bolts and the combinations of bolts and nuts (e.g., without limitation, lock nuts) and bolts, washers (e.g., without limitation, lock washers) and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus, such as a low-voltage circuit breaker 2, including a charging assembly 20 (shown in simplified form in FIG. 1), and a charging handle 24 therefor, in accordance with embodiments of the invention. The low-voltage circuit breaker 2 includes a housing 4 having an exterior 6, an interior 8, and a cover 10. The cover 10 includes a recess 12 (best shown in FIGS. 2, 3, 4A and 4B) extending from the exterior 6 of the housing 4 toward the interior 8. Separable contacts 14, and an operating mechanism, both shown in simplified form in FIG. 1, are enclosed by the housing 4. The operating mechanism 16 is structured to open and close the separable contacts 14 in a well known manner.

The charging assembly 20 includes a spring, indicated generally by reference number 22 in FIG. 1, which is coupled to the operating mechanism 16 and is chargable in order to cause the operating mechanism 16 to close the separable contacts 14. The aforementioned charging handle 24 includes a first end 26 coupled to the charging assembly 20 within the interior 8 of the housing 4, and a second end 28 disposed opposite and distal from the first end 26 and including a finger pull 30. An elongated body 32 extends between the first and second ends 26, 28 of the charging handle 24, and includes a first side 34, a second side 36, an inner surface 38 (FIGS. 2, 4B and 5) which, when the charging handle 24 is disposed in the first or stowed position shown in FIG. 1, is structured to extend toward the interior 8 of the circuit breaker housing 4, and an outer surface 40 disposed opposite the inner surface 38.

Figure 2:
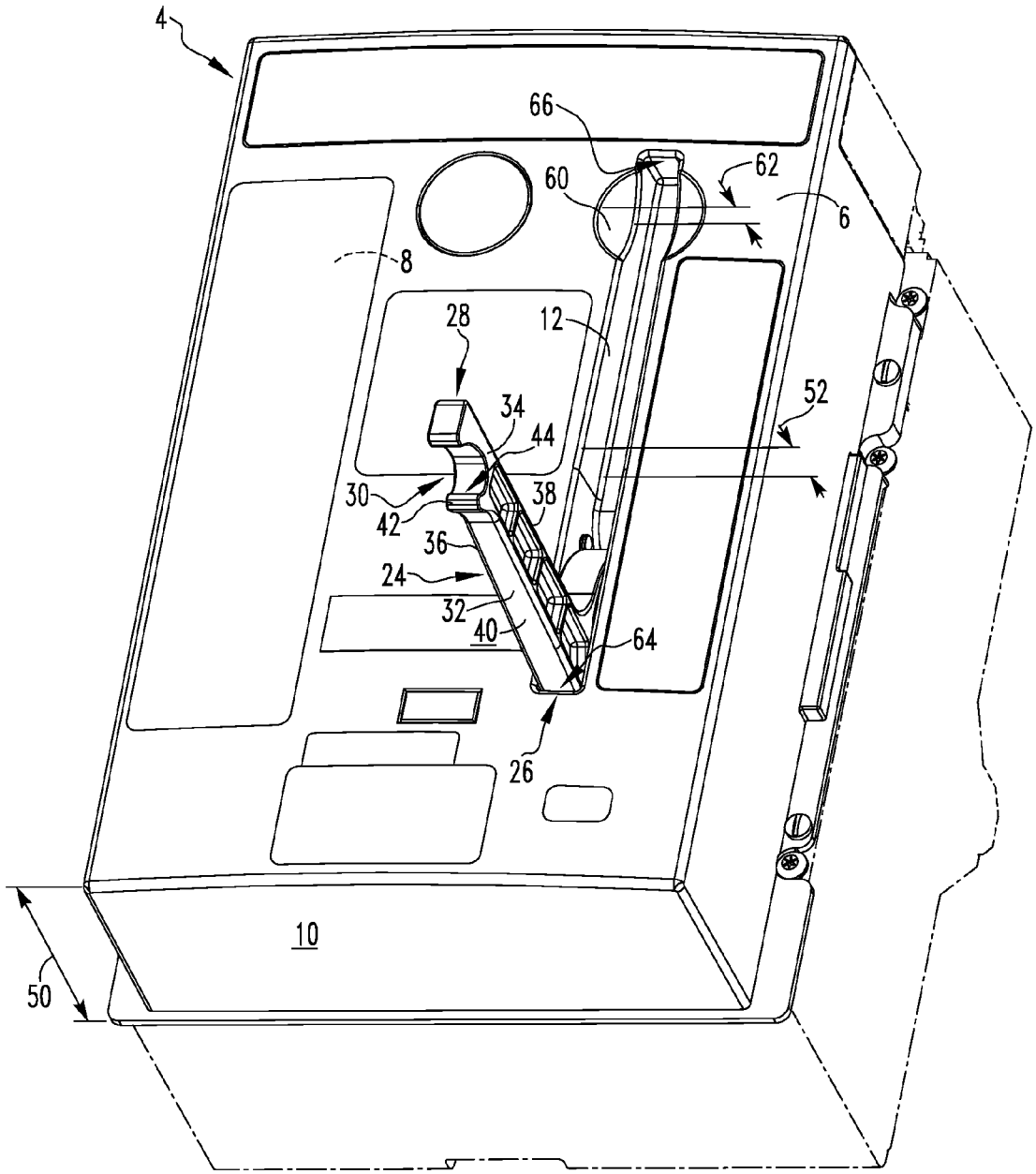
FIG. 2 is an isometric view of the low-voltage circuit breaker of FIG. 1 modified to show the charging handle in a position that when moved from the position of FIG. 1, charges the charging assembly of the circuit breaker operating mechanism.
Figure 3:
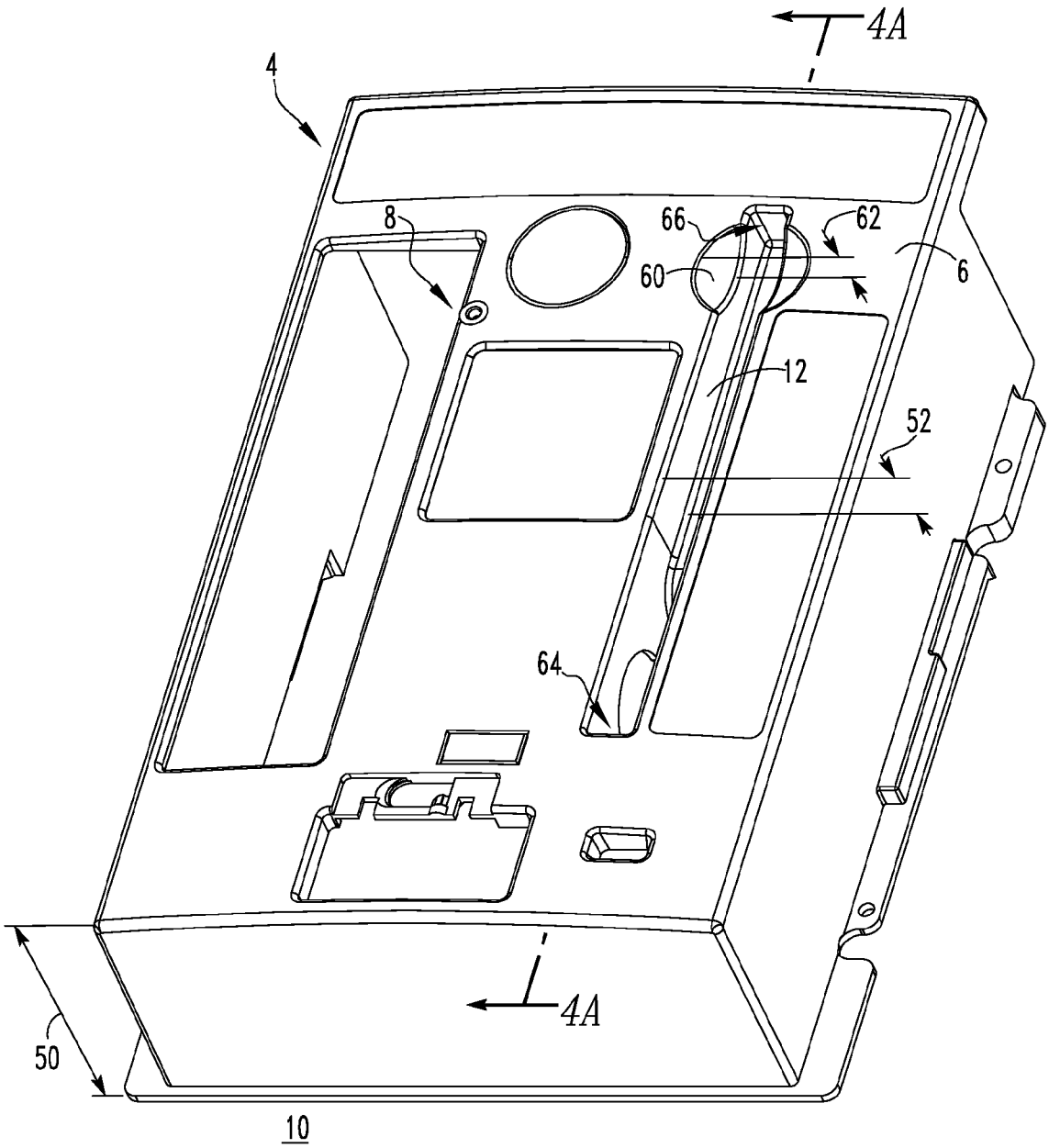
FIG. 3 is an isometric view of the housing cover for the low-voltage circuit breaker of FIG. 1.
Figure 4A:
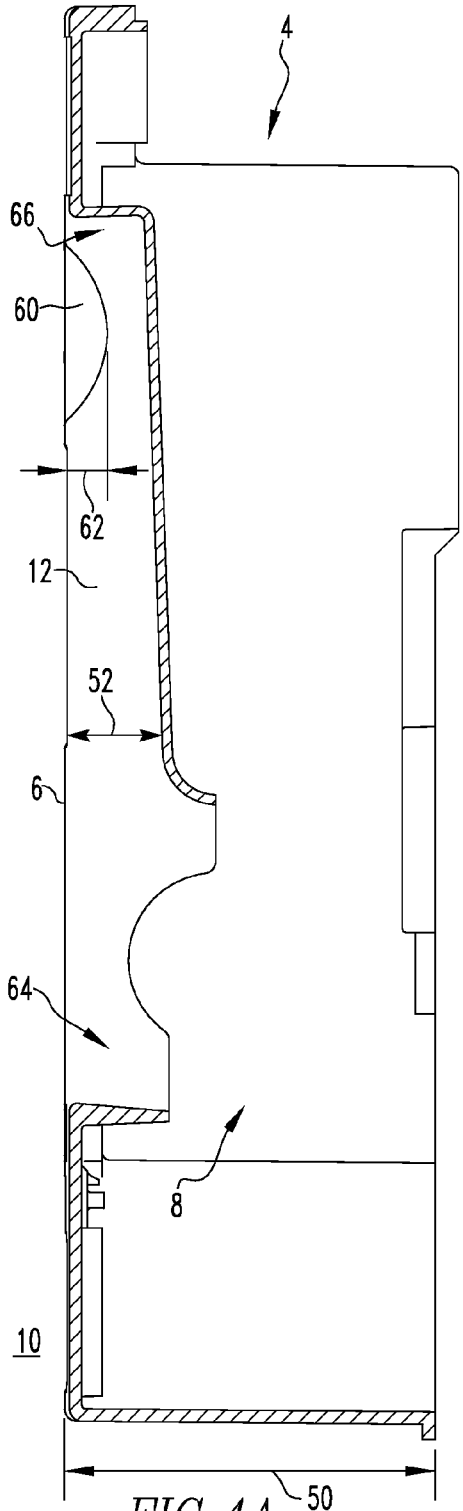
FIG. 4A is a sectional view taken along line 4A-4A of FIG. 3.
Figure 4B:
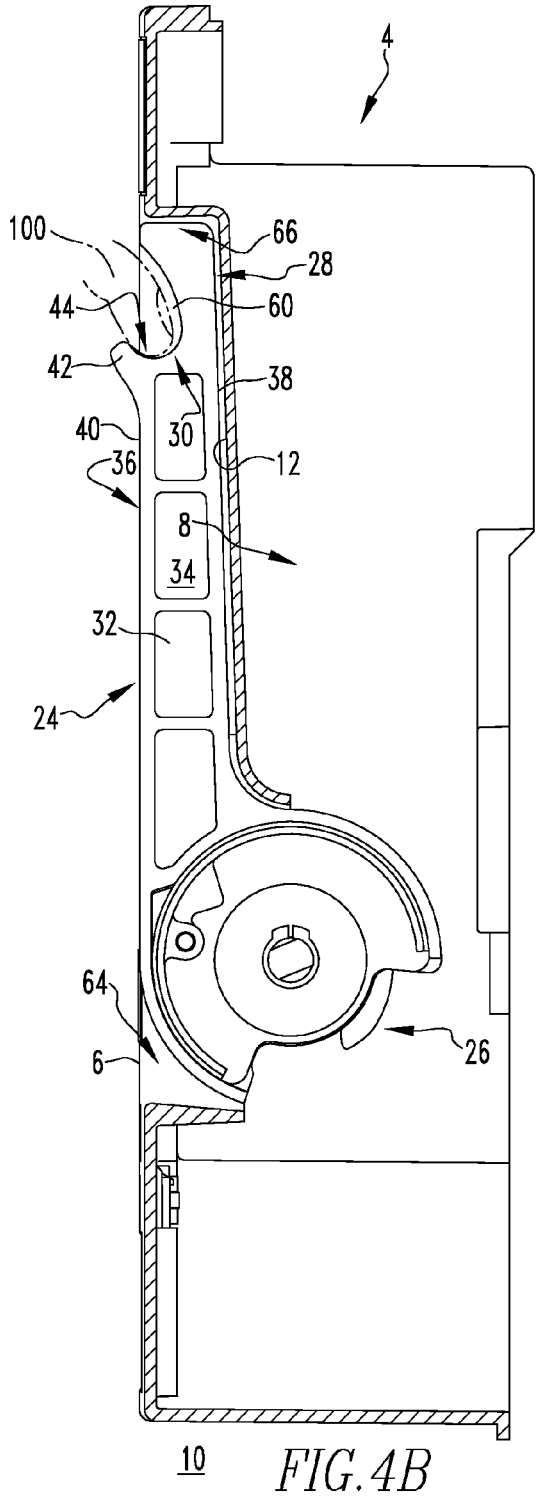
FIG. 4B is the sectional view of FIG. 4A as modified to also show the charging handle in full line drawing in the stowed position within the housing cover.

The charging handle 24 is movable among a first position in which the elongated body 32 of the charging handle 24 is generally disposed within the recess 12 of the housing cover 10, as shown in FIGS. 1 and 4B, and a second position in which the second end 28 of the charging handle 24 extends outwardly from the recess 12 of the housing cover 10, as shown in FIG. 2. When the charging handle 24 is moved from the first position (FIGS. 1 and 4B) toward the second position (FIG. 2), the spring 22 (FIG. 1) of the charging assembly 20 (FIG. 1) is structured to be charged. More specifically, the charging handle 24 is structured to be pulled a number of times in order to charge the spring 22 (FIG. 1) in a well known manner. However, unlike known charging assemblies and charging handles therefor, in which access to the end of the charging handle is somewhat limited (e.g., without limitation, the end of the charging handle is only accessible from one or the other of the left side of the charging handle and the right side of the charging handle; insertion of a finger underneath the end of the charging handle is required in order to remove it from the stowed position in the recess of the housing cover), the finger pull 30 of the disclosed charging handle 24 is disposed on the outer surface 40 of the elongated body 32 of the operating handle 24 at or about the second end 28 thereof. Accordingly, the finger pull 30 is readily accessible from the second end 28 of the charging handle 24, as well as from both the first side 34 (the right side from the perspective of FIGS. 1 and 2) and the second side 36 (the left side from the perspective of FIGS. 1 and 2) of the elongated body 32 of the charging handle 24.

As shown in FIGS. 1-3, 4A and 4B, the example cover 10 of the low-voltage circuit breaker 2 (FIGS. 1 and 2) further includes a finger well 60, which is structured to further facilitate access to the finger pull 30 of the charging handle 24. Specifically, the finger well 60 provides equal access to both of the first and second sides 34, 36 (right and left sides from the perspective of FIGS. 1 and 2) of the charging handle 24. The example finger well 60 is a concave arcuate indentation in the cover 10 of the circuit breaker housing 4, although it will be appreciated that any known or suitable alternative shape and configuration of finger well (not shown) could be employed without departing from the scope of the invention.

To still further facilitate operation of the charging handle 24, the example finger pull 30 includes a protrusion 42, which extends outwardly from the outer surface 40 of the elongated body 32 of the charging handle 24 at or about the second end 28 of the charging handle 24, and/or a pocket 44, which extends inwardly from the outer surface 40 toward the inner surface 38. The example charging handle 24 includes both the protrusion 42 and the pocket 44, although it will be appreciated that it could alternatively have only one or the other (not shown) or any suitable alternative combination (not shown) of both. As best shown in FIG. 4B, when the charging handle 24 is disposed in the first (e.g., stowed) position, the example protrusion 42 is not disposed within the recess 12 of the housing cover 10. Rather, it protrudes above the exterior 6 of the housing 4, in order to be readily engaged by a finger 100 (partially shown in simplified form in phantom line drawing in FIG. 4B). Thus, it will be appreciated that the disclosed finger pull 30 and protrusion 42 and pocket 44 thereof are readily accessible from the exterior 6 of the circuit breaker housing 4 even if, for example, the operator's finger 100 (FIG. 4B) is covered by a work glove (not shown) that is relatively bulky. Accordingly, the disclosed finger pull arrangement overcomes the difficulty of inserting such a gloved finger beneath the end of the charging handle, as required by known prior art charging assembly designs. It will also be appreciated that the finger pull 30 could alternatively employ any suitable number and configuration of protrusions (not shown) or other suitable mechanisms (e.g., without limitation, pocket 44) for engagement by finger 100 (FIG. 4B), other than the single integral protrusion 42 and single pocket 44 shown and described herein.

Continuing to refer to FIG. 4B, it will be appreciated that the second end 28 of the example charging handle 24 extends beyond the finger well 60 (FIG. 4A). In this manner, the charging handle 24 is provided with optimal length 68 (FIG. 5) and associated mechanical leverage. Such additional length 68 (FIG. 5) and associated mechanical leverage functions to overcome many of the disadvantages (e.g., without limitation, excessive pulling force required to perform the charging operation; discomfort to the operator's hand as a result of such excessive force) of known charging handles.

A still further advantage of the disclosed low-voltage circuit breaker 2, and charging assembly 20 and charging handle 24 therefor, is the fact that the recess 12 in the cover 10 of the circuit breaker housing 4 occupies relatively little space within the interior 8 of the housing 4. More specifically, as best shown in FIG. 4A, the cover 10 of the housing 4 has a first depth 50, and the recess 12 of the cover 10 has a second depth 52, which is substantially less than the first depth 50, as shown. Thus, the amount of space occupied by the recess 12 within the interior 8 of the housing 4, is reduced in comparison with, for example, known charging assembly designs wherein the recess in the housing cover is required to be deep enough for the operator's finger (see, for example, finger 100 shown in simplified form in phantom line drawing in FIG. 4B) to fit into the recess and/or beneath the inner surface of the charging handle. Accordingly, the disclosed housing cover 10 and, in particular, the recess 12 therein, is configured so as to optimize the space available within the interior 8 of the circuit breaker housing 4 for internal components (e.g., without limitation, charging assembly; operating mechanism; separable contacts) of the circuit breaker 2 (FIGS. 1 and 2).

Continuing to refer to FIG. 4A, and also to FIG. 4B, it will be appreciated that the example recess 12 has a first end 64, and a second end 66 disposed opposite and distal from the first end 64. The first end 26 of the charging handle 24 is disposed within the first end 64 of the recess 12 and, as shown in FIG. 4B, when the charging handle 24 is disposed in the first position, the second end 28 of the charging handle 24 is substantially disposed within the second end 66 of the recess 12. The example finger well 60, previously discussed, is disposed at or about the second end 66 of the recess 12 and, as best shown in FIG. 4A, has a third depth 62 which is substantially less than the second depth 52 of the recess 12. In one non-limiting example, the third depth 62 of the finger well 60 is about 0.30 inch, whereas the second depth 52 of the recess 12 is about 0.70 inch. Thus, the third depth 62 is "substantially less" than the second depth 52 in that it is less than about 50 percent of the second depth 52, and is preferably about 42 percent of the second depth 52. In the same non-limiting example, the aforementioned first depth 50 of the housing cover 10 is about 3.00 inches. Thus, the second depth 52 of the recess 12 is "substantially less" than the first depth 50 in that it is less than about 30 percent of the first depth 50 of the cover 10, and is preferably about 23 percent of the first depth 50. It will, however, be appreciated that the cover 10, and the recess 12 and the finger well 60 thereof, could have any known or suitable alternative configuration(s) (not shown) and/or dimension(s) (not shown) so as to optimize the space available within the interior 8 of the circuit breaker housing 4 in accordance with the invention.

Figure 5:
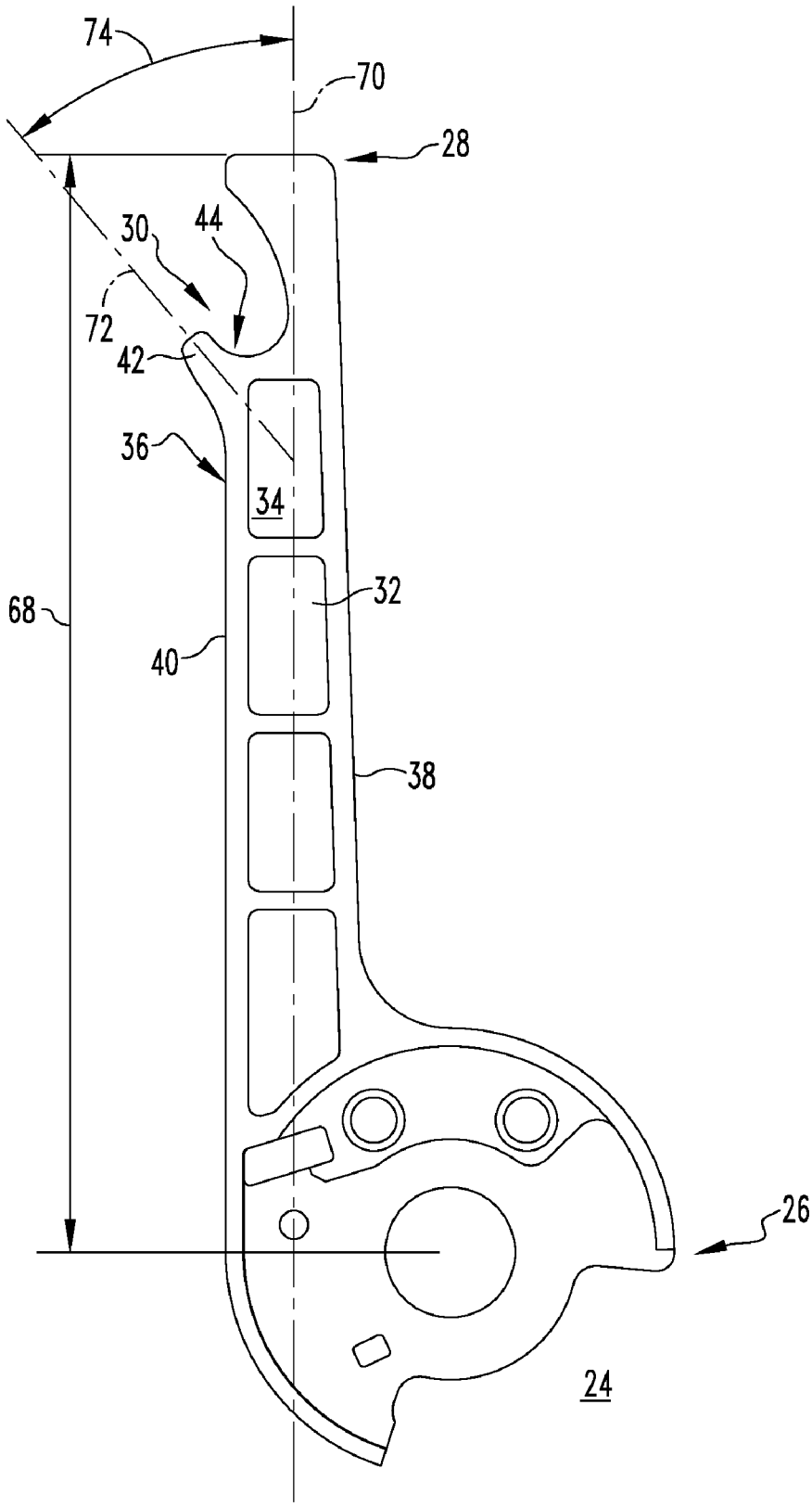
FIG. 5 is a side elevation view of the charging handle of FIG. 4B.

Referring to FIG. 5, the elongated body 32 of the charging handle 24 has a first axis 70 and the aforementioned protrusion 42 of the example finger pull 30 has a second axis 72. An angle 74 is formed between the first and second axes 70, 72, as shown. The angle 74 is preferably less than about 90 degrees, in order that the finger pull protrusion 42 overlays at least a portion of the finger pull pocket 44. In this manner, the finger pull 30 is readily engageable by the operator's finger 100, shown in phantom line drawing in FIG. 4B. This is true even if the operator's finger 100 is covered by a relatively thick glove (not shown).

Accordingly, it will be appreciated that the disclosed charging handle 24 (FIGS. 1, 2, 4B and 5) is optimized to provide numerous advantages over known charging handle designs. Among the advantages are maximized length and associated mechanical leverage, improved accessibility, and an ergonomic and user-friendly design. Specifically, access to the charging handle 24 is provided in an entirely new and improved manner by way of a finger pull 30 which is disposed on the outer surface 40 of the charging handle 24. The finger pull 30 is, therefore, readily accessible from the exterior 6 of the circuit breaker housing 4 and from all of the second end 28 of the charging handle 24, the first side 34 (right side from the perspective of FIGS. 1 and 2) and the second side 36 (left side from the perspective of FIGS. 1 and 2) of the charging handle 24.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A charging handle for an electrical switching apparatus including a housing having an exterior, an interior, a finger well extending from the exterior toward the interior, and a recess extending from the exterior toward the interior, separable contacts enclosed by said housing, an operating mechanism structured to open and close said separable contacts, and a charging assembly, said charging handle comprising:

a first end structured to be coupled to said charging assembly within the interior of said housing;

a second end disposed opposite and distal from the first end and including a finger pull; and an elongated body extending between the first end and the second end, said elongated body including a first side, a second side, an inner surface structured to extend toward the interior of said housing, and an outer surface disposed opposite said inner surface, wherein said charging handle is movable among a first position in which said elongated body is structured to be disposed generally within said recess of said housing, and a second position in which the second end of said charging handle is structured to extend outwardly from said recess of said housing, wherein said finger pull is disposed on the outer surface of said elongated body proximate to the second end of said charging handle and, when said charging handle is disposed in said first position, said finger pull is generally centrally disposed in said finger well, in order that said finger pull is readily accessible for actuation by a human finger from all of: the second end of said charging handle, the first side of said elongated body of said charging handle, and the second side of said elongated body of said charging handle, and wherein the second end of said charging handle extends beyond said finger pull and said finger well.

2. The charging handle of claim 1 wherein said finger pull comprises a protrusion extending outwardly from the outer surface of said elongated body of said charging handle at or about the second end of said charging handle.

3. The charging handle of claim 2 wherein said finger pull further comprises a pocket extending inwardly from the outer surface of said elongated body of said charging handle toward the inner surface of said elongated body of said charging handle at or about the second end of said charging handle.

4. The charging handle of claim 3 wherein said elongated body of said charging handle has a first axis; wherein said protrusion has a second axis; and wherein the first axis of said charging handle and the second axis of said protrusion intersect at an angle.

5. The charging handle of claim 4 wherein said angle is less than 90 degrees, in order that said protrusion of said finger pull overlays at least a portion of said pocket of said finger pull.

6. A charging assembly for an electrical switching apparatus including a housing having an exterior, an interior, a finger well extending from the exterior toward the interior, and a recess extending from the exterior toward the interior, separable contacts enclosed by said housing, and an operating mechanism structured to open and close said separable contacts, said charging assembly comprising:

a spring coupled to said operating mechanism, said spring being structured to be chargeable in order to cause said operating mechanism to close said separable contacts; and a charging handle structured to charge said spring, said charging handle comprising:

a first end structured to be coupled to said charging assembly within the interior of said housing, a second end disposed opposite and distal from the first end and including a finger pull, and an elongated body extending between the first end and the second end, said elongated body including a first side, a second side, an inner surface structured to extend toward the interior of said housing, and an outer surface disposed opposite said inner surface, wherein said charging handle is movable among a first position in which said elongated body is structured to be generally disposed within said recess of said housing, and a second position in which the second end of said charging handle is structured to extend outwardly from said recess of said housing, wherein, when said charging handle is moved from said first position toward said second position, said spring of said charging assembly of said operating mechanism is charged, wherein said finger pull is disposed on the outer surface of said elongated body proximate to the second end of said charging handle and, when said charging handle is disposed in said first position, said finger pull is generally centrally disposed in said finger well, in order that said finger pull is readily accessible for actuation by a human finger from all of: the second end of said charging handle, the first side of said elongated body of said charging handle, and the second side of said elongated body of said charging handle, and wherein the second end of said charging handle extends beyond said finger pull and said finger well.

7. The charging assembly of claim 6 wherein said finger pull comprises a protrusion extending outwardly from the outer surface of said elongated body of said charging handle at or about the second end of said charging handle; wherein said elongated body of said charging handle has a first axis; wherein said protrusion has a second axis; and wherein the first axis of said charging handle and the second axis of said protrusion intersect at an angle.

8. The charging assembly of claim 7 wherein said finger pull further comprises a pocket extending inwardly from the outer surface of said elongated body of said charging handle toward the inner surface of said elongated body of said charging handle at or about the second end of said charging handle.

9. The charging assembly of claim 8 wherein said angle is less than 90 degrees, in order that said protrusion of said finger pull overlays at least a portion of said pocket of said finger pull.

10. An electrical switching apparatus comprising:

a housing including an exterior, an interior, and a cover comprising a recess and a finger well, said recess and said finger well of said cover extending from the exterior of said housing toward the interior of said housing;

separable contacts enclosed by said housing;

an operating mechanism structured to open and closed said separable contacts; and a charging assembly comprising:

a spring coupled to said operating mechanism, said spring being chargeable in order to cause said operating mechanism to close said separable contacts, and a charging handle comprising:

a first end coupled to said charging assembly within the interior of said housing, a second end disposed opposite and distal from the first end and including a finger pull, and an elongated body extending between the first end and the second end, said elongated body including a first side, a second side, an inner surface extending toward the interior of said housing, and an outer surface disposed opposite said inner surface, wherein said charging handle is movable among a first position in which said elongated body is generally disposed within said recess of said cover of said housing, and a second position in which the second end of said charging handle extends outwardly from said recess of said cover of said housing, wherein, when said charging handle is moved from said first position toward said second position, said spring of said charging assembly of said operating mechanism is structured to be charged, wherein said finger pull is disposed on the outer surface of said elongated body proximate to the second end of said charging handle and, when said charging handle is disposed in said first position, said finger pull is generally centrally disposed in said finger well, in order that said finger pull is readily accessible for actuation by a human finger from all of: the second end of said charging handle, the first side of said elongated body of said charging handle, and the second side of said elongated body of said charging handle, and wherein the second end of said charging handle extends beyond said finger pull and said finger well.

11. The electrical switching apparatus of claim 10 wherein said cover of said housing has a first depth; wherein said recess of said cover has a second depth; and wherein the second depth of said recess is substantially less than the first depth of said cover of said housing, in order to minimize the amount of space occupied by said recess within the interior of said housing.

12. The electrical switching apparatus of claim 11 wherein said finger well has a third depth; and wherein the third depth of said finger well is substantially less than the second depth of said recess.

13. The electrical switching apparatus of claim 12 wherein said recess has a first end and a second end disposed opposite and distal from the first end; wherein the first end of said charging handle is disposed within the first end of said recess; wherein, when said charging handle is disposed in said first position, the second end of said charging handle is substantially disposed within the second end of said recess; wherein said finger well is a concave arcuate indentation in said cover of said housing; and wherein said concave arcuate indentation is disposed at or about the second end of said recess.

14. The electrical switching apparatus of claim 13 wherein the second end of said charging handle extends beyond said concave arcuate indentation.

15. The electrical switching apparatus of claim 11 wherein said finger pull comprises at least one of protrusion extending outwardly from the outer surface of said elongated body of said charging handle at or about the second end of said charging handle, and a pocket extending inwardly from the outer surface of said elongated body of said charging handle toward the inner surface of said elongated body of said charging handle at or about the second end of said charging handle.

16. The electrical switching apparatus of claim 15 wherein, when said charging handle is disposed in said first position, said protrusion of said finger pull extends outwardly beyond the exterior of said housing of said electrical switching apparatus, in order that said protrusion is not disposed within said recess of said cover of said housing.

17. An electrical switching apparatus comprising:

a housing including an exterior, an interior, and a cover comprising a recess and a finger well, said recess and said finger well of said cover extending from the exterior of said housing toward the interior of said housing;

separable contacts enclosed by said housing;

an operating mechanism structured to open and close said separable contacts; and a charging assembly comprising:

a spring coupled to said operating mechanism, said spring being chargeable in order to cause said operating mechanism to close said separable contacts, and a charging handle comprising:

a first end coupled to said charging assembly within the interior of said housing, a second end disposed opposite and distal from the first end and including a finger pull, and an elongated body extending between the first end and the second end, said elongated body including a first side, a second side, an inner surface extending toward the interior of said housing, and an outer surface disposed opposite said inner surface, wherein said charging handle is movable among a first position in which said elongated body is generally disposed within said recess of said cover of said housing, and a second position in which the second end of said charging handle extends outwardly from said recess of said cover of said housing, wherein, when said charging handle is moved from said first position toward said second position, said spring of said charging assembly of said operating mechanism is charged, wherein said finger pull is disposed on the outer surface of said elongated body proximate to the second end of said charging handle, wherein, when said charging handle is disposed in said first position, said finger pull is generally centrally disposed in said finger well in order that said cover of said housing provides access to said finger pull from the second end of said charging handle, to both the first side of said elongated body of said charging handle and the second side of said elongated body of said charging handle for actuation by a human finger, and wherein the second end of said charging handle extends beyond said finger pull and said finger well.

18. The electrical switching apparatus of claim 17 wherein said recess has a first end and a second end disposed opposite and distal from the first end; wherein the first end of said charging handle is disposed within the first end of said recess; wherein, when said charging handle is disposed in said first position, the second end of said charging handle is substantially disposed within the second end of said recess; wherein said finger well is a concave arcuate indentation in said cover of said housing; and wherein said concave arcuate indentation is disposed at or about the second end of said recess.

19. The electrical switching apparatus of claim 17 wherein said finger pull comprises at least one of a protrusion extending outwardly from the outer surface of said elongated body of said charging handle at or about the second end of said charging handle, and a pocket extending inwardly from the outer surface of said elongated body of said charging handle toward the inner surface of said elongated body of said charging handle at or about the second end of said charging handle.

* * * * *